US006016592A

United States Patent [19]

Lavender

[11] Patent Number: 6,016,592

[45] Date of Patent: Jan. 25, 2000

[54] PIPE COUPLING TOOL

[75] Inventor: Cecil Lee Lavender, Ocilla, Ga.

[73] Assignee: Aeroquip Corporation, Maumee, Ohio

[21] Appl. No.: 09/042,985

[22] Filed: Mar. 17, 1998

[51] Int. Cl.[7] ..... B25B 27/14

[52] U.S. Cl. ..... 29/272

[58] Field of Search ..... 29/272; 228/49.1, 228/49.3; 269/43

[56] References Cited

U.S. PATENT DOCUMENTS

| | | | |
|---|---|---|---|
| 48,709 | 7/1865 | Emery . | |
| 431,054 | 7/1890 | Henderson | 269/43 |
| 509,458 | 11/1893 | Still . | |
| 928,237 | 7/1909 | Baird . | |
| 1,698,195 | 1/1929 | Karbowski . | |
| 2,498,831 | 2/1950 | Veitch . | |
| 2,816,781 | 12/1957 | Woodling . | |
| 2,907,587 | 10/1959 | Harris et al. . | |
| 3,566,505 | 3/1971 | Martin | 269/37 |
| 4,019,512 | 4/1977 | Tenczar . | |
| 4,219,221 | 8/1980 | Webb . | |
| 4,341,375 | 7/1982 | Romanin | 269/43 |
| 4,585,034 | 4/1986 | Hubbard et al. . | |
| 4,673,400 | 6/1987 | Martin . | |
| 4,674,167 | 6/1987 | Hubbard et al. . | |
| 4,750,662 | 6/1988 | Kagimoto | 228/44.5 |
| 5,052,608 | 10/1991 | McClure | 29/272 |
| 5,624,139 | 4/1997 | Van Kooten . | |

FOREIGN PATENT DOCUMENTS

| | | | |
|---|---|---|---|
| 727340 | 6/1932 | France . | |
| 759272 | 1/1934 | France | 29/272 |
| 531186 | 12/1940 | United Kingdom . | |

OTHER PUBLICATIONS

Brochure No. DPG–21A entitled "Foduct High–Capacity, flexible innerduct for fiber optic cable" by Aeroquip, Nov. 1992.

*Primary Examiner*—David A. Scherbel
*Assistant Examiner*—Daniel G. Shanley
*Attorney, Agent, or Firm*—Emch, Schaffer, Schaub & Porcello Co., L.P.A.

[57] ABSTRACT

A tool having a stationary base mount, a moveable base mount, and clamps for use in coupling pipes. The tool includes a gear device for moving the moveable base mount with respect to the stationary base mount. A first clamp device is positioned on the stationary base mount for clamping a first pipe. A second clamp device is positioned on the moveable base mount for clamping a second pipe. After a slip connector is positioned between the first and second pipes, the gear device is actuated to cause the moveable base mount to move toward the stationary base mount. This results in the slip connector being inserted in the first and second pipes to couple the pipes.

11 Claims, 4 Drawing Sheets

PIPE COUPLING TOOL

BACKGROUND OF THE INVENTION

The present invention relates generally to a pipe coupling tool. More specifically, the invention is directed to a tool that can clamp at least two pipes and draw the pipes together to install a connector to couple the pipes.

It has been found that there is a need for a lightweight tool having a unitized construction that can be used to install connectors to couple plastic pipes or ducts. The tool should provide for the coupling of two or more pipes that can be positioned in conduit. The tool should be easy to use in manhole and handhole environments.

The present invention satisfies the above-identified need by providing a pipe coupling tool that is lightweight and easy to use.

SUMMARY OF THE INVENTION

The pipe coupling tool of the present invention includes a stationary base mount and a moveable base mount. The tool includes a gear device for moving the moveable base mount with respect to the stationary base mount. A first clamp device is positioned on the stationary base mount for clamping a first pipe. A second clamp device is positioned on the moveable base mount for clamping a second pipe. After a slip connector is positioned between the first and second pipes, the gear device is actuated to cause the moveable base mount to move toward the stationary base mount. This results in the slip connector being inserted in the first and second pipes to couple the pipes.

A primary object of the present invention is to provide a pipe coupling tool that is lightweight and easy to use.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
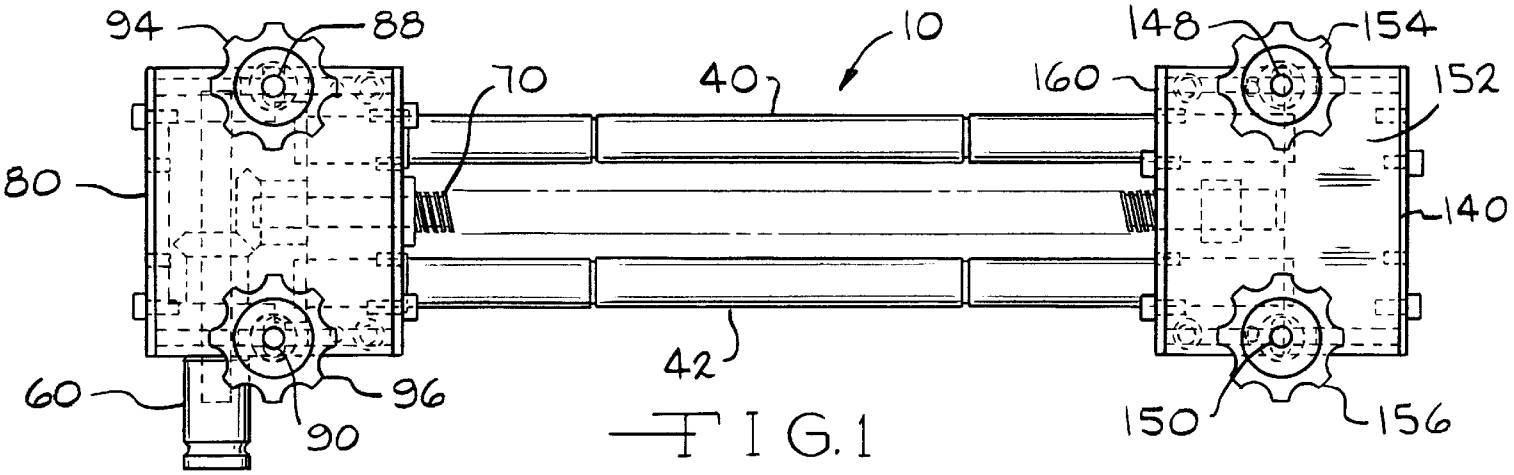
FIG. 1 is a plan view of a pipe coupling tool according to the present invention.

The preferred embodiments and best mode of the present invention will now be described in detail. Referring to the drawings, a pipe coupling tool according to the present invention is indicated generally by the reference number "10".

Figure 2:
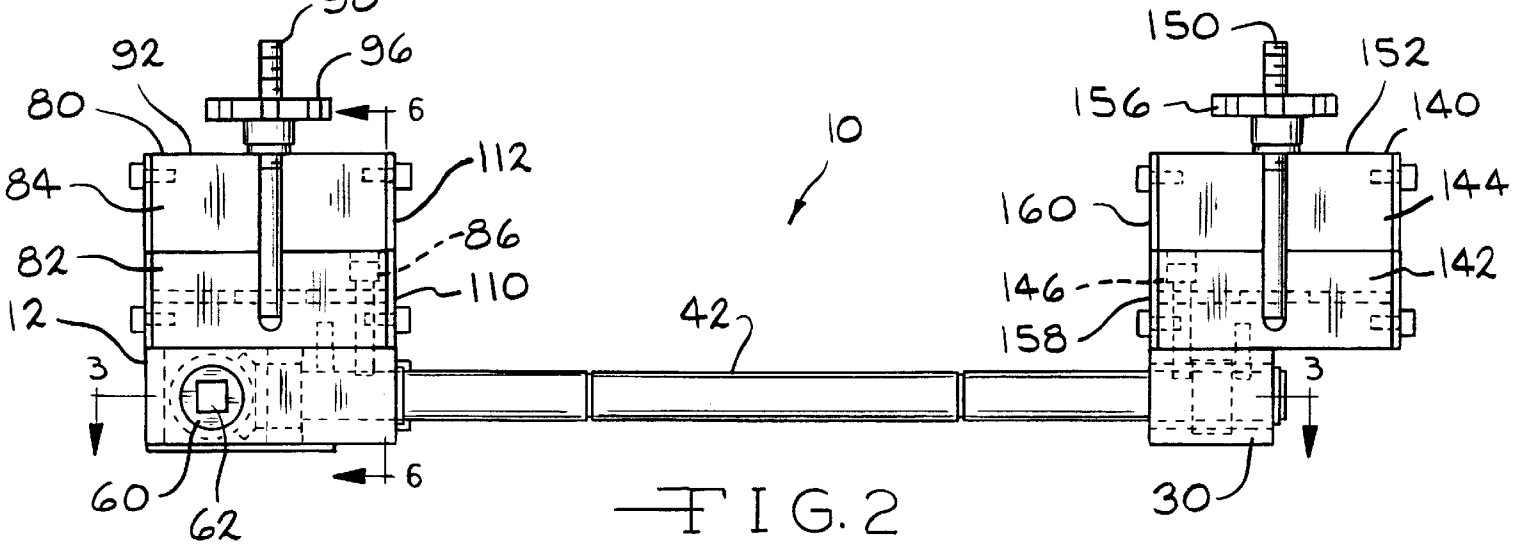
FIG. 2 is a side elevational view of the present invention.
Figure 3:
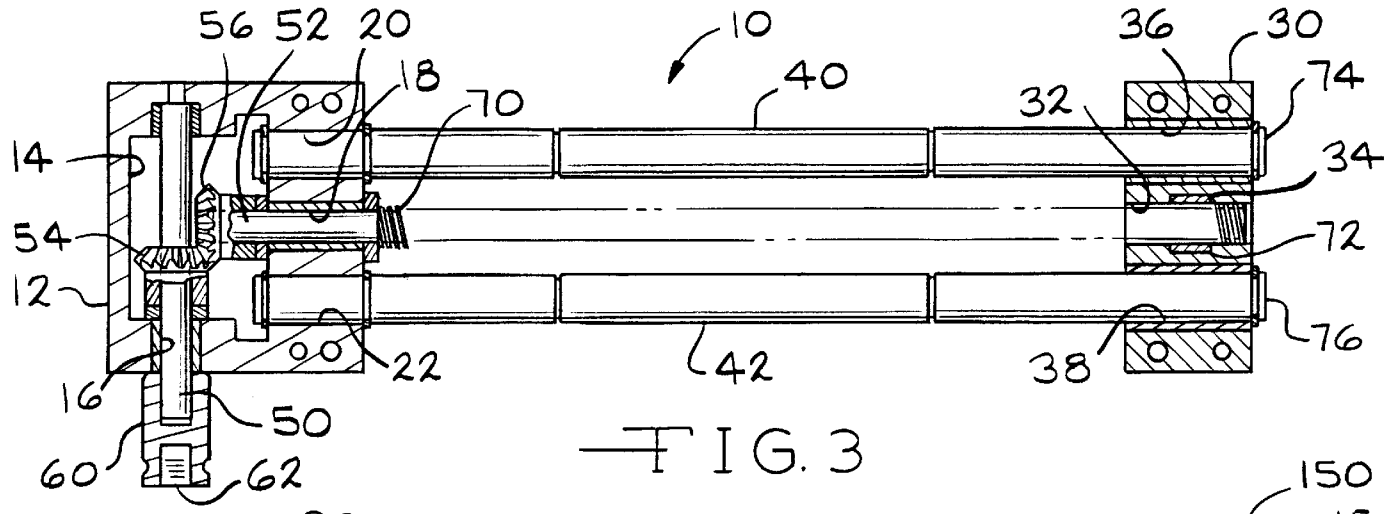
FIG. 3 is a cross-sectional view taken through 3—3 of FIG. 2.

Referring to FIGS. 1–3, the tool 10 includes a stationary base mount 12. The stationary base mount 12 defines a gear housing 14. The stationary base mount 12 further defines an input shaft bore 16 and an output shaft bore 18. The input shaft bore 16 is positioned in a perpendicular relationship with respect to the output shaft bore 18. First and second slide rod bores 20 and 22 are defined by the stationary base mount 12 adjacent and parallel to the output shaft bore 18.

Still referring to FIGS. 1–3, the tool 10 includes a moveable base mount 30. The moveable base mount 30 defines a threaded rod bore 32 having a threaded nut recess 34. Third and fourth slide rod bores 36 and 38 are defined by the moveable base mount 30 adjacent and parallel to the threaded rod bore 32.

As best shown in FIG. 3, the tool 10 includes at least one slide rod. In a preferred embodiment, a first slide rod 40 extends between the first slide rod bore 20 of the stationary base mount 12 and the third slide rod bore 36 of the moveable base mount 30. A second slide rod 42 extends between the second slide rod bore 22 of the stationary base mount 12 and the fourth slide rod bore 38 of the moveable base mount 30. In a preferred embodiment, the first and second slide rods 40 and 42 are fixedly attached to the stationary base mount 12. The moveable base mount 30 is moveably mounted on the first and second slide rods 40 and 42. This allows the moveable base mount 30 to move with respect to the stationary base mount 12 along the first and second slide rods 40 and 42.

Still referring to FIG. 3, an input shaft 50 extends through the input shaft bore 16 into the gear housing 14 defined by the stationary base mount 12. An output shaft 52 extends through the output shaft bore 18 into the gear housing 14. The input shaft 50 is positioned perpendicularly with respect to the output shaft 52. An input gear 54 is positioned on the input shaft 50 within the gear housing 14. A mating output gear 56 is positioned on the output shaft 52 within the gear housing 14. In a preferred embodiment, the input and output gears 54 and 56 consist of miter gears positioned perpendicularly with respect to each other. However, it should be understood that other types of gears can be used depending on the application.

Referring to FIGS. 1–3, the tool 10 includes a socket connector 60 positioned on the input shaft 50. The socket connector 60 includes a recess 62 for receiving, for example, a drive ratchet (not shown) that can be used to turn the socket connector and thereby turn the input shaft 50.

Referring to FIGS. 1 and 3, the tool 10 includes a threaded rod 70 that extends between the stationary base mount 12 and the moveable base mount 30. One end of the threaded rod 70 is fixedly attached to the output shaft 52. The opposite end of the threaded rod 70 extends through the threaded rod bore 32 defined by the moveable base mount 30. As shown in FIG. 3, the threaded nut recess 34 receives a threaded nut 72 that mates with the threaded rod 70. When the threaded rod 70 is turned, the threaded nut 72 cooperates with the threaded rod 70 to allow the rod to turn in both clockwise and counter-clockwise directions to pull or push the moveable base mount 30 along the first and second slide rods 40 and 42. The moveable base mount 30 is prevented from falling off the first and second slide rods 40 and 42 by first and second lock caps 74 and 76.

Referring to FIGS. 1, 2 and 6–8, the tool 10 includes a first clamp 80 positioned on the stationary base mount 12. In a preferred embodiment, the first clamp 80 includes a stationary base block bottom 82 and a stationary base block top 84. The stationary base block bottom 82 is removably attached to the stationary base mount 12 by a plurality of bolts 86. The stationary base block top 84 is moveably mounted on the stationary base block bottom 82 by, in a preferred embodiment, a first swing bolt 88 and a second swing bolt 90 that extend from the stationary base block bottom 82 to a top surface 92 of the stationary base block top 84. First and second hand knobs 94 and 96 are positioned on the first and second swing bolts 88 and 90, respectively. The first and second knobs 94 and 96 can be turned in both clockwise and counter-clockwise directions to move toward or away from the top surface 92 of the stationary base block top 84. When the first and second knobs 94 and 96 are turned in a clockwise direction to move the knobs toward the top surface 92, the knobs 94 and 96 engage the top surface to lock the stationary base block bottom 82 to the stationary base block top 84.

Figure 8:
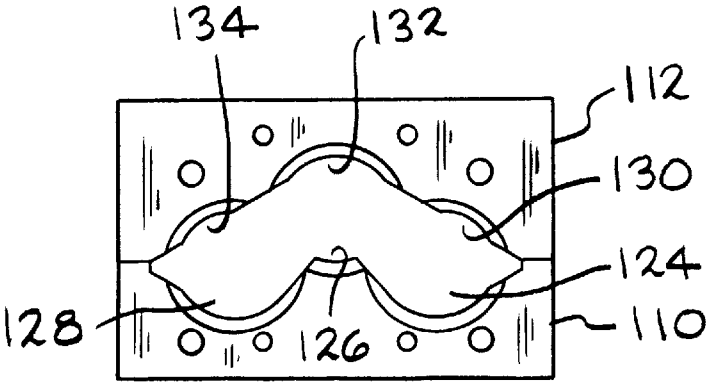
FIG. 8 is a front view of a second embodiment of a stationary base bottom plate and a stationary base top plate.
Figure 7:
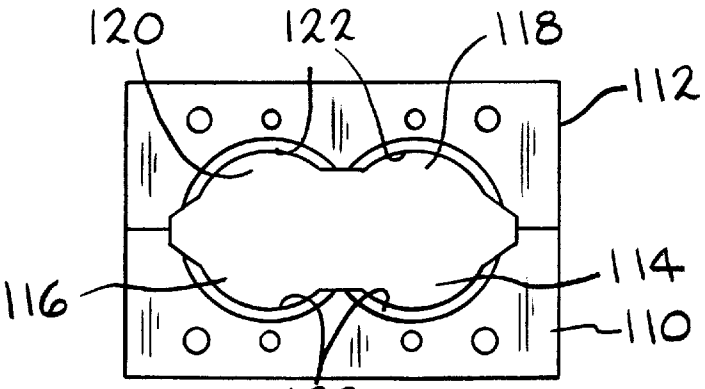
FIG. 7 is a front view of a first embodiment of a stationary base bottom plate and a stationary base top plate.
Figure 6:
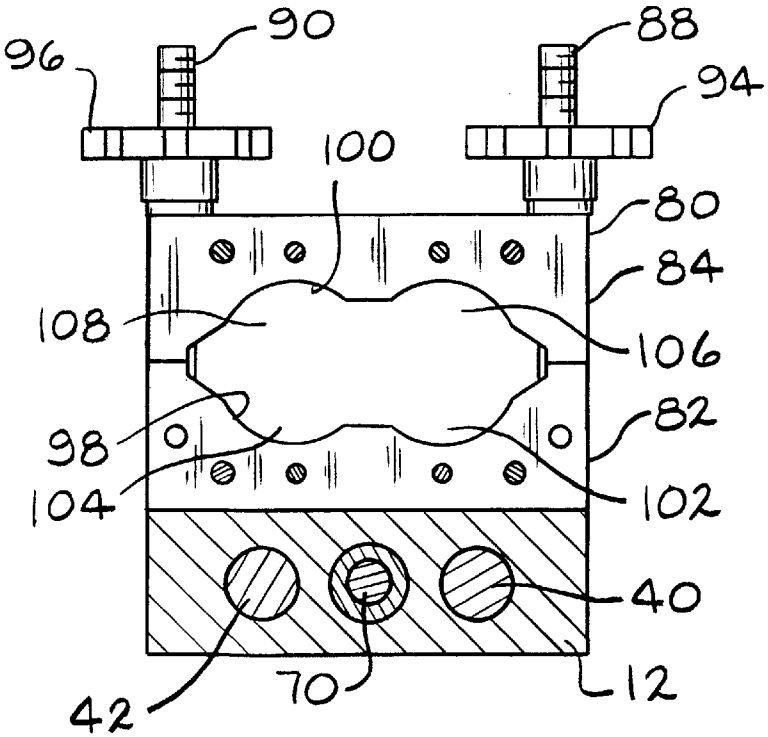
FIG. 6 is a cross-sectional view taken through 6—6 of FIG. 2.

Referring to FIGS. 6–8, an interior bottom surface 98 of the stationary base block bottom 82 and an interior top surface 100 of the stationary base block top 84 define recesses for receiving one or more pipes. In a preferred embodiment, as shown in FIG. 6, the interior surface 98 defines two recesses 102 and 104 and the interior surface 100 defines two corresponding recesses 106 and 108. The recesses 102–108 are adapted to receive two separate pipes (not shown).

Referring to FIGS. 2, 6 and 7, a stationary base bottom plate 110 is mounted on the stationary base block bottom 82 and a stationary base top plate 112 is mounted on the stationary base block top 84. The bottom plate 110 includes two recesses 114 and 116 that correspond to the recesses 102 and 104, respectively, of the stationary base block bottom 82. The top plate 112 defines two recesses 118 and 120 that correspond to the recesses 106 and 108 of the stationary base block top 84. The recesses 114–120 are adapted to receive and engage two separate pipes (not shown). In a preferred embodiment, the bottom and top plates 110 and 112 define sharp edges 122 adjacent the recesses 114–120 to bite into and firmly grip the pipes.

Referring to FIG. 8, a second embodiment of the bottom and top plates 110 and 112 is shown. In this embodiment, the bottom plate 110 defines three recesses 124, 126 and 128. The top plate 112 defines three corresponding recesses 130, 132 and 134. The recesses 124–134 are adapted to receive three separate pipes (not shown). The second embodiment plates are used in conjunction with a stationary base block bottom and a stationary base block top that have interior surfaces that correspond to the recesses 124–134.

Referring to FIGS. 1 and 2, the tool 10 includes a second clamp 140 positioned on the moveable base mount 30. The second clamp 140 includes a moveable base block bottom 142 and a moveable base block top 144. The moveable base block bottom 142 is removably attached to the moveable base mount 30 by a plurality of bolts 146. The moveable base block top 144 is moveably attached to the moveable base block bottom 142 by third and fourth swing bolts 148 and 150 that extend from the moveable base block bottom 142 to a top surface 152 of the moveable base block top 144. A third knob 154 is rotatably mounted on the third swing bolt 148 and a fourth knob 156 is rotatably mounted on the fourth swing bolt 150. The moveable base block top 144 is locked to the moveable base block bottom 142 in the same manner as described above with respect to the stationary base block top 84 and the stationary base block bottom 82. The moveable base block bottom 142 and the moveable base block top 144 have interior surfaces that define recesses for receiving pipes as defined above with respect to the stationary base block bottom 82 and the stationary base block top 84. As shown in FIGS. 1 and 2, the second clamp 140 includes a moveable base block bottom plate 158 attached to the moveable base block bottom 142 and a moveable base block top plate 160 attached to the moveable base block top 144. The plates 158 and 160 define recesses and sharp edges for receiving and gripping pipes as described above with respect to the stationary base bottom plate 110 and the stationary base top plate 112.

Both the first and second clamps 80 and 140 can be easily removed from the stationary base mount 12 and the moveable base mount 30, respectively, by loosening the bolts 86 and 146, respectively. This allows for other clamps having various recess and plate configurations to be easily attached to the stationary base mount 12 and the moveable base mount 30 depending on the use of the tool 10. For example, if two sets of pipes are to be coupled, clamps having plates as shown in FIG. 7 can be used. If three sets of pipes are to be joined together, clamps having plates as shown in FIG. 8 can be used.

Figure 4:
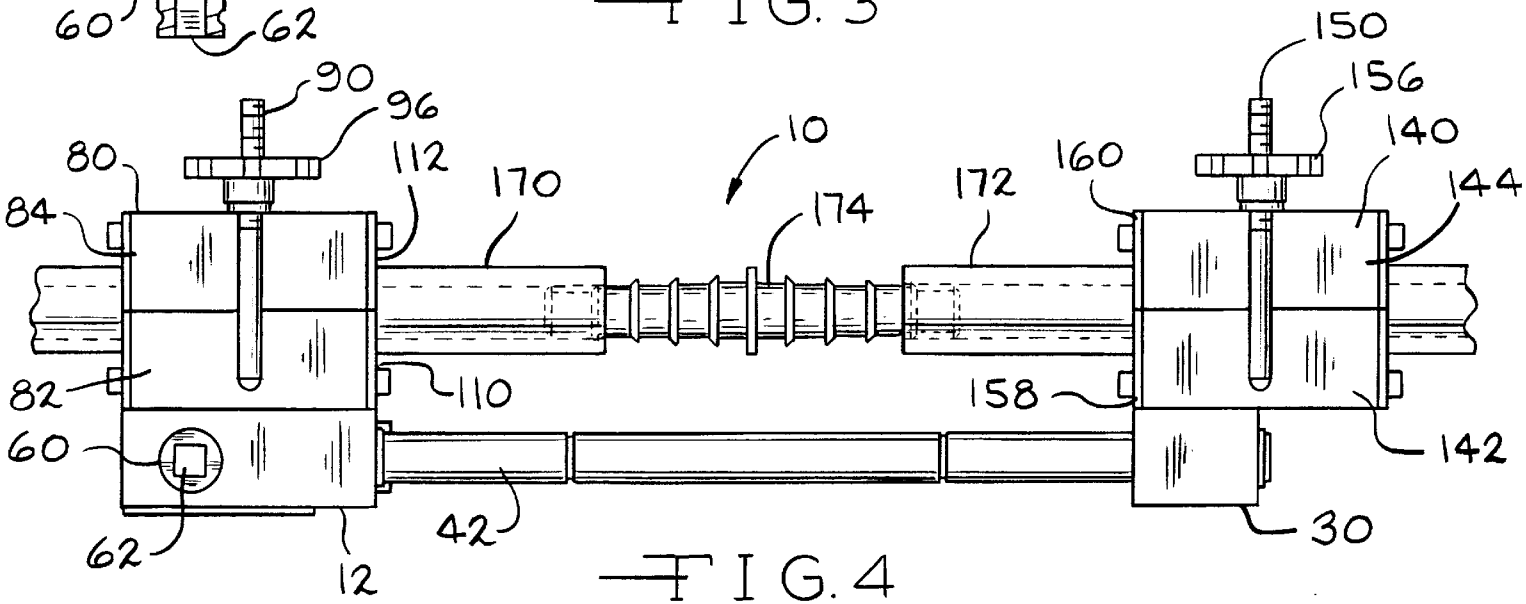
FIG. 4 is a view similar to the view of FIG. 2 showing a slip connector positioned between a first pipe and a second pipe that are clamped by the present invention.
Figure 5:
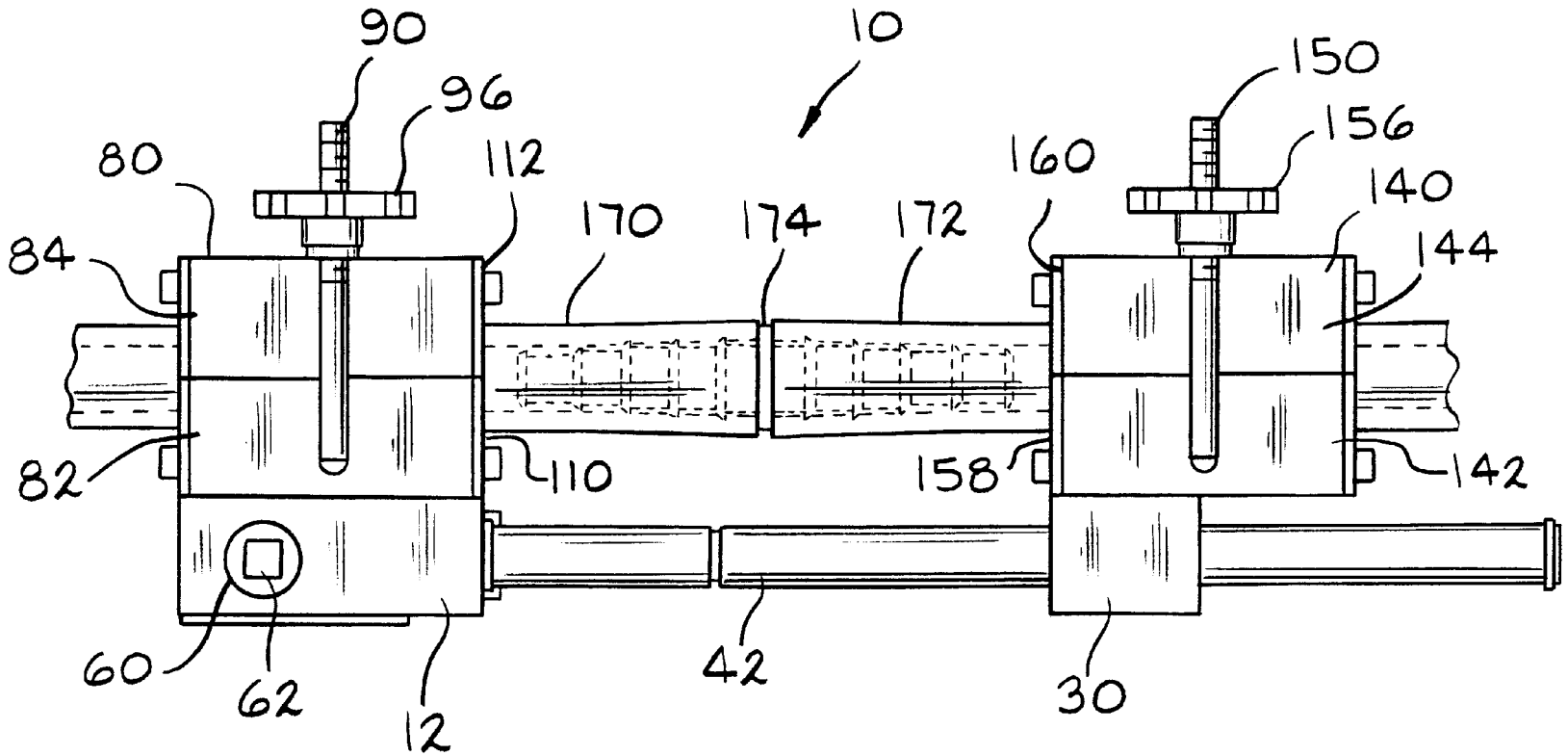
FIG. 5 is a view similar to the view of FIG. 4 showing the slip connector fully inserted in the first and second pipes.

The intended use and operation of the present invention will now be described in detail. Referring to FIGS. 3 and 4, a first pipe 170 is positioned in the first clamp 80. A second pipe 172 is positioned in the second clamp 140. A slip connector 174 is positioned between the first and second pipes 170 and 172. A drive device, such as an electric or pneumatic drive ratchet (not shown), is inserted in the recess 62 defined by the socket connector 60. Actuation of the drive ratchet causes rotation of the input shaft 50 and the input gear 54. The input gear 54 mates with the output gear 56 to cause rotation of the output shaft 52. Rotation of the output shaft 52 causes corresponding movement of the threaded rod 70. Cooperation between the threaded nut 72 and the rotating threaded rod 70 results in movement of the moveable base mount 30 along the first and second slid rods 40 and 42 toward the stationary base mount 12. As shown in FIG. 5, movement of the moveable base mount 30 toward the stationary base mount 12 causes the slip connector 174 to be inserted in the first and second pipes 170 and 172 to couple or connect the pipes. The coupled pipes are then released from the first and second clamps 80 and 140. The moveable base mount 30 is then moved away from the stationary base mount 12 by actuating the drive ratchet in an opposite direction. This causes the socket connector 60 to turn the input shaft 50, the input gear 54, the output shaft 52, the output gear 56 and the threaded rod 70 in an opposite direction to cause the moveable base mount 30 to move away from the stationary base mount 12.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A pipe coupling tool, comprising;

a stationary base mount;

a moveable base mount;

gear means for moving said moveable base mount with respect to said stationary base mount, said gear means consisting of an input shaft operatively connected to an output shaft by an input gear positioned on said input shaft and a mating output gear positioned on said output shaft, said output shaft being operatively connected to said moveable base mount;

first clamp means positioned on said stationary base mount for clamping a first pipe; and second clamp means positioned on said moveable base mount for clamping a second pipe.

2. The tool of claim 1, wherein said tool further includes at least one slide rod, said stationary base mount being fixedly attached to said rod, said moveable base mount being movably mounted on said rod.

3. The tool of claim 1, wherein said input shaft is positioned substantially perpendicular with respect to said output shaft.

4. The tool of claim 1, wherein said input gear and said output gear consist of miter gears positioned substantially perpendicular with respect to each other.

5. The tool of claim 1, wherein said gear means further includes turning means for turning said input shaft.

6. The tool of claim 5, wherein said turning means consists of a socket connector.

7. The tool of claim 1, wherein said gear means further includes a threaded rod operatively connected to said output shaft and said moveable base mount.

8. The tool of claim 1, wherein said first clamp means consists of a stationary base block bottom and a stationary base block top movably mounted on said stationary base block bottom, each of said stationary base block bottom and top defining at least one recess for receiving said first pipe.

9. The tool of claim 8, wherein said first clamp means further includes at least one swing bolt extending between said stationary base block bottom and said stationary base block top and at least one knob rotatably mounted in said swing bolt whereby tightening of said knob locks said stationary base block bottom to said stationary base block top.

10. The tool of claim 1, wherein said second clamp means consists of a moveable base block bottom and a moveable base block top movably mounted on said moveable base block bottom, each of said moveable base block bottom and top defining at least one recess for receiving said second pipe.

11. The tool of claim 10, wherein said second clamp means further includes at least one swing bolt extending between said moveable base block bottom and said moveable base block top and at least one knob rotatably mounted on said swing bolt whereby tightening of said knob locks said moveable base block bottom to said moveable base block top.

* * * * *